US006058652A

United States Patent [19]

Uhl

[11] Patent Number: 6,058,652

[45] Date of Patent: May 9, 2000

[54] REVOLVING DOOR BRAKING AND LOCKING DEVICE

[75] Inventor: Albert Uhl, Sinzheim/Kartung, Germany

[73] Assignee: Kaba Gallenschütz GmbH, Bühl/Baden, Germany

[21] Appl. No.: 09/151,150

[22] Filed: Sep. 10, 1998

[30] Foreign Application Priority Data

Sep. 11, 1997 [DE] Germany ..... 197 39 819

[51] Int. Cl.[7] ..... E05D 15/02

[52] U.S. Cl. ..... 49/43; 49/138

[58] Field of Search ..... 49/42, 43, 138, 49/139, 140

[56] References Cited

U.S. PATENT DOCUMENTS

| | | | |
|---|---|---|---|
| 1,014,997 | 1/1912 | Blickensderfer . | |
| 2,186,385 | 1/1940 | Lockart . | |
| 2,267,632 | 12/1941 | Wunsch | 49/43 |
| 3,497,997 | 3/1970 | Sheckells | 49/43 |
| 3,678,623 | 7/1972 | Jenkins | 49/43 |
| 4,154,023 | 5/1979 | Carroll | 49/43 X |
| 4,475,308 | 10/1984 | Heise et al. | 49/43 X |
| 4,976,065 | 12/1990 | Beran et al. | 49/43 |
| 5,647,173 | 7/1997 | Stark et al. | 49/43 X |

FOREIGN PATENT DOCUMENTS

| | | |
|---|---|---|
| 27 58 089 | 7/1978 | Germany . |
| 42 31 984 | 3/1994 | Germany . |

*Primary Examiner*—Jerry Redman
*Attorney, Agent, or Firm*—Collard & Roe, P.C.

[57] ABSTRACT

A manually operable carousel revolving door having a locking element with a rotary axle disposed inside. The door comprises a braking motor, a rotational speed detector and a rotation direction detector, all actively connected to the locking element. If the door rotates at a speed above a predetermined rate or in a wrong direction, the rotation speed detector and the rotation direction detector signals the braking motor to act on the rotary axle of the locking element to slow the rotation rate of the door. The braking motor can be disposed in a receptacle in the top side covering in the revolving door. In addition, the braking motor can be connected to the rotary axle via a chain drive or a toothed gear drive.

10 Claims, 1 Drawing Sheet

REVOLVING DOOR BRAKING AND LOCKING DEVICE

BACKGROUND OF THE INVENTION

1. Field of the Invention

This invention relates to a manually actuated carousel-type revolving door having a locking element. The door is designed in the form of a multi-arm turnstile that rotates around a vertical axle between lateral limiting walls.

2. Description of the Prior Art

These carousel-type revolving doors have been known in the prior art for a long time and are particularly used as gates for people in buildings and delimited areas.

However, manual operation of these door installations poses a risk in that the locking element is set in motion with excessive momentum and therefore moves with a rather high speed of rotation. This may consequently cause injury to those who next enter the revolving door.

One possibility to deal with this danger would be to design the locking element with a certain sluggishness, permitting high speeds of rotation to be reached only with considerable force. However, this solution is not practical with doors fitted with heavy or large locking elements. This would, furthermore, inhibit the quick passage of people through the revolving door.

The present invention is an improvement over the prior art because the locking element limits high rotational speeds on revolving doors while assuring quick passage of persons through the revolving door.

SUMMARY OF THE INVENTION

This problem is solved in that the locking element is actively connected with a breaking motor as well as with a means for detecting both the speed of rotation, and the direction of rotation of the locking element. This braking motor acts at above a predetermined amount of detected speed of rotation or at a predetermined direction of rotation on the axle of rotation. The brake creates a torque oriented against the direction of rotation of the locking element.

According to the invention, the speed of rotation of the locking element is continually detected. A braking motor acts on the locking element above a predetermined limit speed and brakes the speed of rotation of the locking element.

If the speed of rotation is less then the limit speed, the braking action of the motor stops. An unhindered passage of persons through the carousel-type revolving door is therefore assured at low rotational speeds.

This invention therefore creates a lock or block in the rotary motion at least in one predetermined direction by causing the braking motor to act during this rotation. Here, the braking motor will rotate only at its lowest possible rotary motion if the doors rotate in the opposite direction, yet will allow rotation at higher speeds in the proper direction of rotation. This carousel type revolving door will therefore rotate only in one direction. This invention is advantageous because it makes mechanical locks in doors unnecessary.

The door has a braking motor with an electronic control on which the limit speed is adjustable. The limit speed is the speed at which the rate of rotation of the braking motor starts to act on the locking element. The braking motor basically generates a reverse torque on the locking element to keep the door from rotating.

An infinitely variable potentiometer can be used to adjust the rotational speed. The potentiometer is preferably arranged on a circuit board together with other electronic components. This potentiometer is manually adjustable so that the limit speed can be set when the electronics are shut off.

The braking motor is designed as a direct current motor that is controlled inductively, and is short circuited by the electronics when the limit speed is reached. The short circuit causes the breaking motor to act or operate on the locking element.

Another important element in the invention, is that no external power supply is required for the electronics because the electronic control is powered by the voltage generated by the rotation of the braking motor. In addition, the invention provides for a mechanical coupling between the braking motor and the rotary axle of the locking element. The mechanical coupling is designed to produce a non-positive connection above a predetermined rotational speed.

To service the rotary speed limitation, the braking motor is spaced apart from the axle of rotation of the locking element, and connected to the axle via a suitable driving means.

Chain or toothed gear drives are provided as a driving means between the braking motor and the rotary axle. However, other connection possibilities are available, such as for example, a belt drive.

In another embodiment of the invention, the braking motor is placed in the roof construction of the carousel type revolving door, and is thus easily accessible if repairs are needed. However the braking motor may also be arranged on the floor or the subfloor of the carousel-type revolving door installation.

It is therefore an object of the invention to provide a carousel door having a locking system that has a means for detecting the rotary speed and the direction of rotation of an element.

Another object of the invention is to provide a carousel door having a locking system that has a braking system that is spaced apart from the rotary axle.

Another object of the invention is to provide a carousel door having a locking system that is simple in design, inexpensive to manufacture, and easy to install.

BRIEF DESCRIPTION OF THE DRAWINGS

Other objects and features of the present invention will become apparent from the following detailed description considered in connection with the accompanying drawing which disclose one embodiment of the present invention. It should be understood, however, that the drawing is designed for the purpose of illustration only, and not as a definition of the limits of the invention.

In the drawing, wherein similar reference characters denote similar elements throughout the two views.

DETAILED DESCRIPTION OF THE PREFERRED EMBODIMENT

Figure 1:
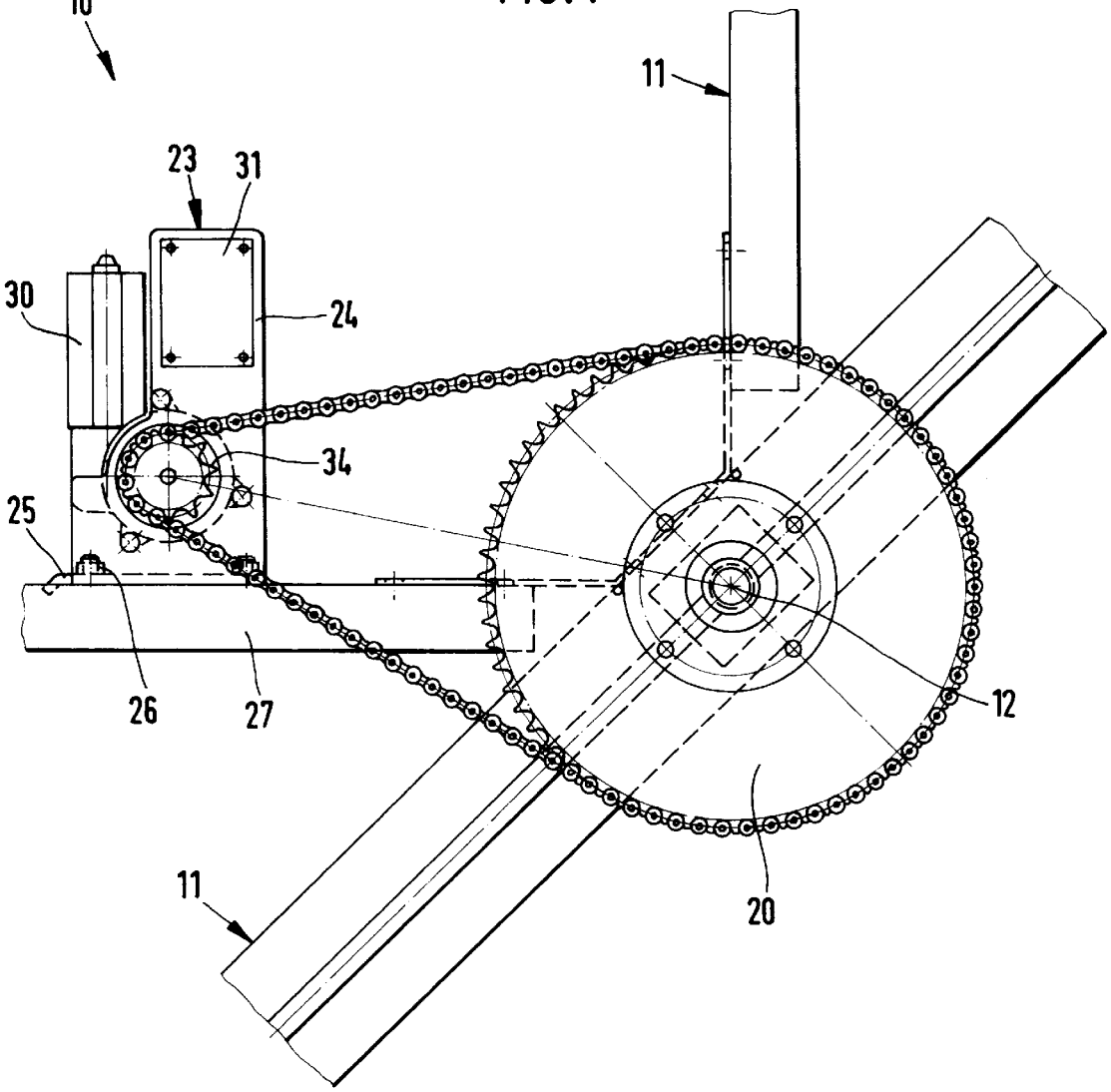
FIG. 1 is a top view showing the elements of the rotary speed limitation device arranged within the roof of a carousel type revolving door; and, FIG. 2 is a cross-sectional side view of the elements of a rotary speed limitation device of FIG. 1 with a sprocket wheel drive.
Figure 2:
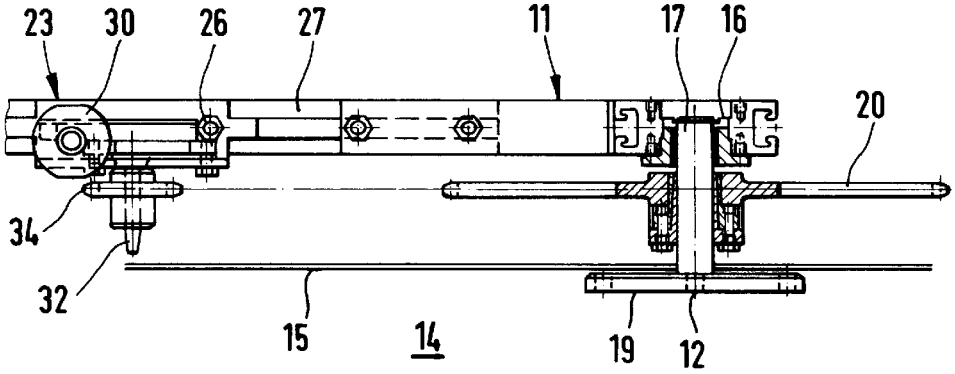

Referring to FIGS. 1 and 2 there is shown a cutout from a carousel-type revolving door comprising a door locking element in the form of a multi-arm turnstile. The locking element is rotatably supported, turning around a vertical axle 12, disposed between lateral limiting walls spaced apart from each other and manually rotatable around its axle.

Revolving door 10 is equipped with a rotary speed limitation device disposed on a top-side cover of revolving door 10. The cover has a support element 11 consisting of a plurality of sections, which are joined with each other. In addition, the cover has a surface 15 that is vertically spaced apart from the roof construction in the direction of the intended passage area of carousel-type revolving door 10.

Support element 11 is equipped with a bearing receptacle 16, in which the locking element of revolving door 10 is rotatably received by means of a trunnion 17. Trunnion 17 rotates around vertical axle 12 and extends from bearing receptacle 16 through an opening on surface 15. On a side of surface 15, facing away from support element 11, trunnion 17 is fitted with a mounting plate 19 which is designed to receive wings of the revolving door.

A sprocket wheel 20 is disposed between support element 11 and surface 15 on trunnion 17, and connected to trunnion 17 with torsional strength. Sprocket wheel 20 serves to actively connect rotary axle 12 of the locking element with braking drive 23.

Braking drive 23 is mounted on console 24, which is spaced from rotary axle 12. Drive 23 is secured with a covering or projecting holding section 27 of support element 11 by means of screw connections 26. Braking drive 23 comprises an electric braking motor 30 and control electronics 31, which are mounted on console 24. Furthermore, a driving shaft 32 is rotatably supported on the console. Shaft 32 is in a driving connection with electric motor 30. A sprocket wheel 34 is connected to driving shaft 32, with the shaft extending parallel with rotary axle 12 of the locking element. A driving means shown as chain 35 is guided on two sprocket wheels 20 and 34. This driving chain 35 establishes a direct active connection between rotary axle 12 of the locking element, and motor 30.

When the locking element of carousel revolving door 10 is manually put into rotation in a predetermined rotational direction, this rotary motion is transmitted via sprocket wheel 20. As shown in FIG. 1, sprocket wheel 20 connects to sprocket wheel 34 via chain 35. Therefore, as sprocket wheel 20 rotates, it also drives sprocket wheel 34. The rotary motion of drive shaft 32, which is actively connected with motor 30, is detected by measuring electronics 41 and the detected value is transmitted to the control electronics 31. Measuring electronics 41 include a rotational speed detector to detect the rotational speed of the door and a rotation direction detector to detect the rotational direction of the door. Control electronics 31 compares the transmitted values from measuring electronics 41 to the present rotary limit speed. If the actual rotational speed of driving shaft 32 exceeds the present rotational limit speed, then control electronics 31 transmits a control command to motor 30.

Motor 30 is designed as a DC motor with a permanent magnet. If, in the event the preset rotational limit speed is exceeded, the control command triggered by control electronics 31 causes motor 30 to become short circuited. In this result, the braking moment acts against the rotational direction transmitted via the loop drive. Due to the motor counter-torque, the rotational motion of the locking element of the revolving door is stopped as long as the actual rotational speed is higher than the preset rotational limit speed.

The torque, triggered by short-circuiting motor 30 is dependant upon the rotational speed of the door. When the actual rotational speed drops due to the preset rotational limit speed or below, control electronics 31 transmit a control command to a motor 30 to cancel the short circuit. This consequently cancels the braking effect of motor 30, and the locking element of revolving door installation 10 can then be actuated again without any braking counter-torque acting on it.

Revolving door installation 10 is designed to actuate the locking element in only one rotational direction. Control electronics 31 are consequently adjusted so that in the direction opposite the preset direction, the rotational limit speed is near zero. One turn of the locking element against the predetermined rotational motion is electronically detected and causes motor 30 to be short circuited. The short circuit is caused by a control command emitted by control electronics 31. This command causes a braking moment to counteract a rotational motion against the present direction. The locking element therefore cannot be actuated against the predetermined rotational direction without a considerable amount of force. Thus, it is virtually impossible to pass through the carousel door against the predetermined direction of rotation.

In another embodiment of the invention, revolving door installation 10 includes a centrifugal clutch 39 disposed around driving shaft 32. Centrifugal clutch 39 is designed to brake the rotation of door 10 as the rotation rate increases to above the threshold rotation rate.

In a third embodiment of the invention, the driving means is a toothed gear drive that connects braking motor 30 to rotary axle 12.

Accordingly, while several embodiments of the present invention has been shown and described, it is to be understood that many changes and modifications may be made thereunto without departing from the spirit and scope of the invention as defined in the appended claims.

What is claimed is:

1. A manually operable carousel revolving door having a locking element with a rotary axle comprising:

a) a braking motor actively connected to the locking element;

b) a rotational speed detector actively connected to the locking element; and c) a rotation direction detector connected to the locking element wherein at a rotational speed above a predetermined rate and at a predetermined direction of rotation, said rotational speed director and said rotation direction detector signals said braking motor to act on the rotary axle of the locking element to slow a rotation rate of the door.

2. The door as claimed in claim 1, wherein the braking motor has an electric control to adjust the rate of rotational speed at which the braking motor starts to act.

3. The door as claimed in claim 2, wherein the braking motor is a direct-current motor controlled by inductive coupling.

4. The door as claimed in claim 2, wherein said electronic control is powered by a voltage generated by said braking motor.

5. The door as claimed in claim 1, further comprising a mechanical coupling including a centrifugal clutch interconnected between the braking motor and the rotary axle so that it non positively couples the braking motor and the rotary axle at a speed of rotation that is above a predetermined rate.

6. The door as claimed in claim 1, wherein said braking motor is spaced apart from the rotary axle and further comprises a driving means that drives the rotary axle through a friction grip.

7. The door as claimed in claim 6, wherein said driving means is a chain drive that connects the rotary axle of the locking element to the braking motor.

8. The door as claimed in claim 6, wherein said driving means is a toothed gear drive that connects the rotary axle of the locking element to the braking motor.

9. The door as claimed in claim 1, wherein the door further comprises a covering disposed on a top side of the door, the covering being a receptacle for the braking motor.

10. A manually operable carousel revolving door having a locking element with a rotary axle comprising:

a) a braking motor actively connected to the locking element said braking motor comprising an electric control to adjust a rate of rotational speed at which the braking motor starts to act, wherein said electric control is powered by a voltage generated by said braking motor;

b) a rotational speed detector actively connected to the locking element; and c) a rotation direction detector connected to the locking element wherein at a rotational speed above a predetermined rate and at a predetermined direction of rotation, said rotational speed director and said rotation direction detector signals said braking motor to act on the rotary axle of the locking element to slow the rotation rate of the door.

* * * * *